US010260497B2

(12) United States Patent
Lei et al.

(10) Patent No.: US 10,260,497 B2
(45) Date of Patent: Apr. 16, 2019

(54) POWER UNIT OF HYDRAULIC PUMPING UNIT AND CORRESPONDING HYDRAULIC PUMPING UNIT

(71) Applicant: Bosch Rexroth (Changzhou) Co., Ltd., Changzhou (CN)

(72) Inventors: Zhengzhong Lei, Wujin (CN); Pei Sun, Wujin (CN); Yongbo Chen, Wujin (CN)

(73) Assignee: Robert Bosch GmbH, Stuttgart (DE)

( * ) Notice: Subject to any disclaimer, the term of this patent is extended or adjusted under 35 U.S.C. 154(b) by 277 days.

(21) Appl. No.: 14/890,386

(22) PCT Filed: May 8, 2014

(86) PCT No.: PCT/CN2014/077034

§ 371 (c)(1),
(2) Date: Nov. 10, 2015

(87) PCT Pub. No.: WO2014/180322

PCT Pub. Date: Nov. 13, 2014

(65) Prior Publication Data

US 2016/0131130 A1 May 12, 2016

(30) Foreign Application Priority Data

May 10, 2013 (CN) ..... 2013 1 0173892

(51) Int. Cl.
*F04B 47/04* (2006.01)
*F15B 21/14* (2006.01)
(Continued)

(52) U.S. Cl.
CPC ..... *F04B 47/04* (2013.01); *F04B 9/10* (2013.01); *F04B 49/002* (2013.01); *F04B 49/12* (2013.01);
(Continued)

(58) Field of Classification Search
CPC ..... F04B 9/10; F04B 47/04; F04B 49/002; F04B 49/12; F04B 49/22; F15B 21/14;
(Continued)

(56) References Cited

U.S. PATENT DOCUMENTS 4,707,993 A * 11/1987 Kime ..... F04B 47/04 60/372
4,723,107 A * 2/1988 Schmid ..... F15B 21/14 318/139

(Continued)

FOREIGN PATENT DOCUMENTS

CN 101446305 A 6/2009
CN 202181885 U 4/2012

(Continued)

OTHER PUBLICATIONS

International Search Report corresponding to PCT Application No. PCT/CN2014/077034, dated Aug. 8, 2014 (Chinese and English language document) (6 pages).

*Primary Examiner* — Patrick Hamo
*Assistant Examiner* — Joseph S. Herrmann
(74) *Attorney, Agent, or Firm* — Maginot, Moore & Beck LLP

(57) ABSTRACT

Disclosed is a power unit of a hydraulic pumping unit, which comprises a motor; a pumping rod driving device for driving reciprocating movement of a pumping rod; a variable pump driven by the motor, the variable pump hydraulically connected to the pumping rod driving device; a secondary hydraulic control unit hydraulically connected to the pumping rod driving device; an energy accumulator being in transmission connection with the secondary hydraulic control unit; a sensor for setting a stroke of the pumping rod; a first control device adapted to, based on the signals from the sensor, set the discharge capacity of the variable pump to be zero during the declining process of the pumping rod and to
(Continued)

be positive during the ascending process of the pumping rod to drive the pumping rod driving device; and a second control device adapted to based on the signals from the sensor, set the secondary hydraulic control unit to function as a motor for driving the energy accumulator to accumulate energy during the descending process of the pumping rod, and to be driven by the energy accumulator to function as a pump for driving the pumping rod driving device during the ascending process of the pumping rod. The present invention further discloses a corresponding hydraulic pumping unit. The hydraulic pumping unit has high energy recycling utilization efficiency and is simple and reliable.

12 Claims, 1 Drawing Sheet

(51) Int. Cl.

| | |
|---|---|
| ***F04B 9/10*** | (2006.01) |
| ***F04B 49/12*** | (2006.01) |
| ***F04B 49/22*** | (2006.01) |
| ***F04B 49/00*** | (2006.01) |

(52) U.S. Cl.
CPC ..... *F04B 49/22* (2013.01); *F15B 21/14* (2013.01); *F15B 2211/20546* (2013.01); *F15B 2211/20569* (2013.01); *F15B 2211/20576* (2013.01); *F15B 2211/7052* (2013.01); *F15B 2211/761* (2013.01)

(58) Field of Classification Search
CPC .. F15B 2211/20546; F15B 2211/20569; F15B 2211/20576; F15B 2211/7052; F15B 2211/761; F15B 2211/88
USPC ..... 417/237, 426, 427, 428, 429
See application file for complete search history.

(56) References Cited

U.S. PATENT DOCUMENTS

| | | | | |
|---|---|---|---|---|
| 5,647,208 | A * | 7/1997 | Spitzbarth | F04B 9/06 60/371 |
| 5,827,051 | A * | 10/1998 | Smith | E21B 47/0008 417/375 |
| 7,234,298 | B2 * | 6/2007 | Brinkman | E02F 9/2217 60/414 |
| 7,426,826 | B2 * | 9/2008 | Adleff | F16D 33/08 60/330 |
| 8,083,499 | B1 * | 12/2011 | Krug | E21B 43/126 417/390 |

FOREIGN PATENT DOCUMENTS

| | | |
|---|---|---|
| CN | 202866762 | 4/2013 |
| CN | 203239662 U | 10/2013 |
| CN | 103775031 A | 5/2014 |

* cited by examiner

POWER UNIT OF HYDRAULIC PUMPING UNIT AND CORRESPONDING HYDRAULIC PUMPING UNIT

This application is a 35 U.S.C. § 371 National Stage Application of PCT/CN2014/077034, filed on May 8, 2014, which claims the benefit of priority to Serial No. CN 201310173892.0, filed on May 10, 2013 in China, the disclosures of which are incorporated herein by reference in their entirety.

TECHNICAL FIELD

The present invention relates to oil extraction equipment, and especially to a power unit of a hydraulic pumping unit and a hydraulic pumping unit comprising the power unit.

BACKGROUND ART

During the existing oil extraction process, it is necessary to seek for "an artificial method" if crude oil can not naturally flow out from the production well for lack of internal pressure or other reasons, and at present the beam pumping unit is most common, which is normally called as a "Nodding machine". The beam pumping unit is mainly comprised of a beam-linkage-crank mechanism, a reduction gearbox, a three-phase asynchronous motor, auxiliary devices and the like. When extracting oil, it has the low overall efficiency, small power factor and high electrical energy consumption. Further, the beam pumping unit has the huge size, low energy saving efficiency, high cost and low yield, and it is inconvenient to execute the installation and maintenance.

Therefor, the Chinese patent CN202181885U discloses a hydraulic pumping unit, which comprises a secondary control hydraulic unit, an oil cylinder controlled by the secondary control hydraulic unit to drive reciprocating movement of a pumping rod, a sensor for setting a stroke of the piston rod (i.e., the pumping rod) of the oil cylinder, a asynchronous motor in transmission connection with the secondary control hydraulic unit, a potential energy accumulator (preferably in the form of a flywheel) in transmission connection with the asynchronous motor, and a secondary control hydraulic unit controller adapted to control the forward and reverse motion of the secondary control hydraulic unit based on the signal from the sensor. By means of such type of hydraulic pumping unit, the stroke and speed can be flexibly controlled according to the characteristics of the oil well, thereby achieving the sufficient oil extraction and enhancing the yield. Further, the electrical energy consumption is reduced, with the improved production efficiency, since the potential energy accumulator can accumulate the potential energy and thereafter release it.

In the hydraulic pumping unit, the flywheel, the asynchronous motor and the secondary control hydraulic unit share one shaft. During the downward movement of the pumping rod, the secondary control hydraulic unit as a motor drives rotation of the flywheel to convert the gravity potential energy of the pumping rod and so on into rotational kinetic energy. Thus, the energy conversion efficiency mainly depends on the variation range of the rotation speed of the flywheel. According to this design, the flywheel is mechanically coupled to the motor, that is, the flywheel and the rotor of the motor must experience the synchronous rotation. Thus, the speed variation range of the flywheel, which is critical to the energy recycling utilization, is directly constrained by the velocity range of the motor. Just for this reason, it is desired to allow for the maximum velocity variation range for the motor. Since the synchronous motor has a strictly fixed speed, the asynchronous motor is the option as described above. However, even for the asynchronous motor, the allowed speed variation range is still limited. The energy recycling utilization is therefore greatly restricted.

On the other hand, if the speed variation range is fixed, the energy recycling capacity is only related with the inertia of the flywheel. This will lead to the very great size and weight of the flywheel, thereby causing huge problems for the actual production and installation.

In this case, it is urgent to provide a reliable hydraulic pumping unit which has the simple structure and the high energy recycling utilization efficiency.

CONTENTS OF THE INVENTION

One object of the present invention, is to provide a power unit of a hydraulic pumping unit and a hydraulic pumping unit comprising the power unit, so as to overcome at least one of the above disadvantages.

According to the first aspect of the present invention, a power unit, of a hydraulic pumping unit is provided, which comprises:

- a motor,
- a pumping rod driving device for driving reciprocating movement of a pumping rod,
- a variable pump driven by the motor, the variable pump hydraulically connected to the pumping rod driving device,
- a secondary hydraulic control unit hydraulically connected to the pumping rod driving device,
- an energy accumulator being in transmission connection with the secondary hydraulic control unit,
- a sensor for setting a stroke of the pumping rod,
- a first control device adapted to, based on the signals from the sensor, set the discharge capacity of the variable pump to be zero during the declining process of the pumping rod and set the discharge capacity of the variable pump to be positive during the ascending process of the pumping rod to drive the pumping rod driving device, and
- a second control device adapted to, based on the signals from the sensor, set the secondary hydraulic control unit to function as a motor for driving the energy accumulator to store energy during the descending process of the pumping rod, and to be driven by the energy accumulator to function as a pump for driving the pumping rod driving device during the ascending process of the pumping rod.

Preferably, the secondary hydraulic control unit is a bidirectional plunger pump, and/or the energy accumulator is a flywheel, and/or the pumping rod driving device comprises an oil cylinder or hydraulic winch.

Preferably, the first control device is a first control valve hydraulically connected to the variable pump, and/or the second control device is a second control valve hydraulically connected to the secondary hydraulic control unit.

Preferably, the first and second control valves are a proportional relief valve or a proportional reversing valve or a combination of a common electromagnetic reversing valve and a pressure valve.

Preferably, the direction in which the pumping rod driving device draws the pumping rod is in a line with the moving direction of the pumping rod.

Preferably, the power unit further comprises a control pump for supplying the variable pump with control oil via the first control valve and supplying the secondary hydraulic control unit with control oil via the second control valve, the control pump being in transmission connection with the variable pump and being coaxially disposed with the motor and the variable pump.

Preferably, provided between the variable pump and the pumping rod driving device is a check valve, which allows hydraulic oil to only flow from the variable pump to the pumping rod driving device, and/or provided between the secondary hydraulic control unit and the pumping rod driving device is a hydraulically-controlled check valve, which is adapted to keep opened during the normal declining operation process of the pumping rod, and to prevent hydraulic oil from flowing from the pumping rod driving device to the secondary hydraulic control unit in the case of shutdown or abnormal situations.

Preferably, the sensor is an analogue sensor or consists of an upper proximity switch and a lower proximity switch.

Preferably, the power unit further comprises a hydraulic divider motor adapted to drive a plurality of pumping rod driving devices simultaneously.

According to the second aspect of the present invention, a hydraulic pumping unit is provided, which comprises at least one the power unit.

The power unit according to the present invention causes the flywheel to be disengaged from the motor but only in transmission connection with the secondary hydraulic control unit, and this can expand the flywheel speed variation range, thereby enhancing the energy recycling utilization efficiency and reducing the size of the flywheel. The structure of such a design is simple and reliable, and the motor at the low cost is allowed, thereby further reducing the equipment cost.

DESCRIPTION OF THE DRAWINGS

The present invention will be described hereinafter in more details with reference to the drawings, so as to better appreciate the principles, characteristics and advantages of the claimed invention.

EMBODIMENTS

The embodiments of the invention will be described hereinafter in more details with reference to the drawings, so as to better appreciate the basic concept of the invention.

Figure 1:
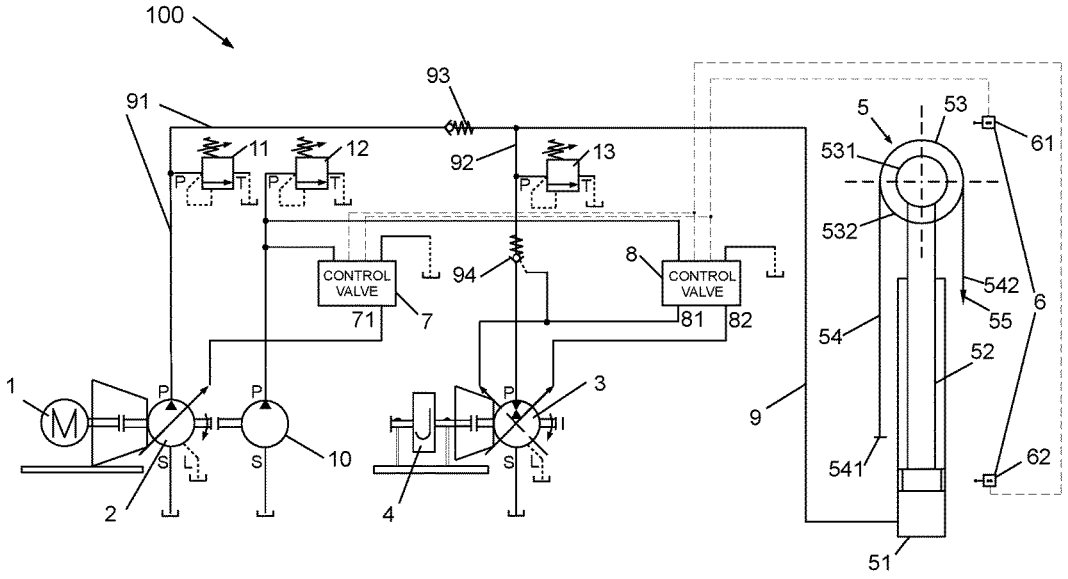
FIG. 1 is an abbreviated view illustrating a power unit of a hydraulic pumping unit according to one illustrative embodiment of the invention.

FIG. 1 is an abbreviated view illustrating a power unit 100 of a hydraulic pumping unit according to one illustrative embodiment of the invention.

As shown in FIG. 1, the power unit 100 comprises a motor 1, a variable pump 2 being in transmission connection with the motor 1 so as to be driven by the motor 1, a secondary hydraulic control unit 3, a flywheel 4 being in transmission connection with the secondary hydraulic control unit 3 so as to rotate with the secondary hydraulic control unit 3, a pumping rod driving device 5 for driving reciprocating movement of a pumping rod (not shown), a sensor 6 for setting a stroke of the pumping rod, a first control valve 7 for controlling the variable pump 2 in accordance with signals from the sensor 6, and a second control valve 8 for controlling operating mode of the secondary hydraulic control unit 3 in accordance with signals from the sensor 6.

In the illustrative embodiment illustrated by FIG. 1, the pumping rod driving device 5 is hydraulically driven by a drive hydraulic line 9 connected thereto, and a variable pump hydraulic line 91, which is connected to a port P of the variable pump 2, and a secondary hydraulic control unit hydraulic line 92, which is connected to a port P of the secondary hydraulic control unit 3, are together connected to the drive hydraulic line 9.

During the declining process of the pumping rod, the second control valve 8 controls the secondary hydraulic control unit 3 based on the signal from the sensor 6 to change the operating mode of the secondary hydraulic control unit 3, so as to enable it to act as a motor. Here, the secondary hydraulic control unit 3 outputs moment of torque at the output end by using gravitational potential energy of the pumping rod and of structural members on the pumping driving device 5 that move downwards with the pumping rod, so as to drive accelerated rotation of the flywheel 4. At the same time, the first control valve 7 during this process likewise controls the variable pump 2 based on the signal from the sensor 6, to preferably set the displacement of the variable pump 2 to be zero, i.e., closing the variable pump 2.

When the pumping rod comes to the lower dead point of the stroke and starts to ascend, the second control valve 8 changes the operating mode of the secondary hydraulic control unit 3 based on the signal from the sensor 6, so as to enable it to act as a pump. At the same time, the first control valve 7 turns on the variable pump 2 to work with certain displacement based on the signal from the sensor 6, so that the motor 1 and the flywheel 4 function as power sources for driving the variable pump 2 respectively and driving, together with the secondary hydraulic control unit 3 that acts as a pump at this moment, the pumping rod driving device 5 to drive ascending movement of the pumping rod for executing oil extraction.

As described above, the variable pump 2 can be turned on and off by means of control of the first control valve 7, exhibiting the variable pump-displacement, and the secondary hydraulic control unit 3 can act as a pump or a motor by means of control of the second control valve 8. Thereby, the gravitational potential energy of the pumping rod and of structural members on the pumping rod driving device 5, which members move downwards with the pumping rod, and the motor 1 can be sufficiently used via the flywheel 4 to collectively drive ascending of the pumping rod, thereby greatly reducing the energy consumption of the motor 1.

The motor 1 may be a common motor or a slip motor.

The secondary hydraulic control unit 3 preferably is a bidirectional plunger pump, and its operating mode can be changed under the action of the second control valve 8. At the normal operation, it is driven at the input end (i.e., driven by the flywheel 4) and therefore functions as a pump so as to drive together with the variable pump 2 the ascending of the pumping rod for pumping oil, while the pumping rod descends to generate potential energy, the secondary hydraulic control unit 3 utilizes as a motor the potential energy to output the moment of torque at the output end to drive the accelerated rotation of the flywheel 4, with the purpose of storing the gravitational potential energy and thereby providing a part dynamic force for the subsequent ascending motion of the pumping rod.

Further, the power unit 100 further comprises a control pump 10 for supplying the variable pump 2 with control oil via the first control valve 7 to control the variable pump 2 and, supplying the secondary hydraulic control unit 3 with control oil via the second control valve 8 to change the operating mode of the secondary hydraulic control unit 3. The output ends of the variable pump 2, the control pump 10 and the secondary hydraulic control unit 3, i.e., their ports P, also are connected to relief valves 11, 12, 13 respectively so as to avoid very high pressure. Preferably, the control pump 10 is connected to the variable pump 2 in a transmission mode. In this case, it is preferable to coaxially dispose the motor 1, the variable pump 2 and the control pump 10 so as to make both the two pumps driven by the motor 1, thereby making the whole structure of the power unit 100 more compact. The transmission shaft between the motor 1, the variable, pump 2 and the control pump 10 always rotate in one direction, as indicated by the arrow in the clockwise direction in FIG. 1. Certainly, the rotation can be made in the counterclockwise direction.

According to one illustrative embodiment, the variable pump hydraulic line 91 is provided therein with a check valve 93, which when working only allows hydraulic oil to flow from the variable pump 2 to the drive hydraulic line 9.

According to one illustrative embodiment, the secondary hydraulic control unit hydraulic line 92 is provided therein with a hydraulically-controlled check valve 94. The hydraulically-controlled check valve 94 during the normal declining process of the pumping rod is in the opened state by means of the hydraulically-controlled manner, so as to allow the hydraulic oil according to the running state to flow in any direction between the secondary hydraulic control unit 3 and the pumping rod driving device 5, and is switched into such a state in the case of abnormal situations where flow of the hydraulic oil from the pumping rod driving device 5 to the secondary hydraulic control unit 3 is not allowed. In this way, it is possible to prevent the safety problem caused by the accidental drop of the pumping rod and structural members on the pumping rod driving device 5 that move with the pumping rod.

In the illustrative embodiment shown in FIG. 1, the pumping rod driving device 5 comprises an oil cylinder 51, which is fixedly mounted on a cylinder holder (not shown) or directly mounted on an oil-well tree (not shown). The oil cylinder 51 has an open upper end a closed lower end. A lower end of a cylinder piston rod 52 is disposed in the oil cylinder 51 in an oil sealing and slideable manner, and an upper end of the cylinder piston rod 52 protrudes out of the oil cylinder 51 and is equipped with a pulley block 53 (runner assembly). The pulley block 53 comprises a stationary shaft 531 that is fixedly connected to the upper end of the cylinder piston rod 52, and the cylinder piston rod 52 is vertical to the stationary shaft 531, so that when the cylinder piston rod 52 moves up and down, it also drives the stationary shaft 531 to move up and down. The stationary shaft 531 is equipped with a movable pulley 532 rotatable around it, and the movable pulley 532 is wound with a traction member 54, such as wire ropes or belts and the like. A first end 541 of the traction member 54 is fixed to the cylinder holder or other stationary parts, and a second end 542 thereof bypasses the movable pulley 532 and is fixedly connected to the pumping rod (via a hanger 55 such as) to drive reciprocating movement of the pumping rod.

When the cylinder piston rod 52 goes up, the stationary shaft 531 does therewith, and the friction force between the traction member 54 and the movable pulley 532 and the weight of the pumping rod cause the traction member 54 to rotate relative to the stationary shaft 531 together with the movable pulley 532 (in the counterclockwise direction in FIG. 1) so that the second end 542 of the traction member 54 ascends and thereby drives the pumping rod to go up for pumping oil, since the first end 541 of the traction member 54 is fixed and the movable pulley 532 is rotatable relative to the stationary shaft 531.

When the cylinder piston rod 52 goes down, the stationary shaft 531 does therewith, and the traction member 54 follows the movable pulley 532 to rotate in the opposite direction (in the clockwise direction in FIG. 1) relative to the stationary shaft 531, so that the second end 542 of the traction member 54 descends and the pumping rod goes down therewith.

When the cylinder piston rod 52 moves, the moving stroke of the pumping rod is twice as large as the stroke of the cylinder piston rod 52 due to use of the pulley block 53. Thereby, with the stroke of the pumping rod unchanged, the length of the oil cylinder 51 and the cylinder piston rod 52 can be greatly reduced to decrease the height and overall weight of the equipment and to facilitate the transportation and the on-site installation and debugging, so that it is suitable for places such as ocean platforms, desert or snowfield or other formidable natural conditions, and further the structural stability is enhanced, exhibiting the greater resistance against wind.

Please note that the amount of the stationary shaft 531 is not limited to one, and the amount of the movable pulley 532 is not limited to one. For example, two movable pulleys can be respectively disposed at both ends of the stationary shaft 531. In other words, combinations of plural stationary shafts and more plural movable pulleys can be used, so as to provide the different times of stroke. Further, according to the requirement of the stroke, combination of the fixed pulleys and movable pulleys also can be used.

As described above, the present invention uses the pulley block 53 to extend the stroke, but is not limited to this. The present invention also can utilize other forms of runner assemblies, such as sprocket block, belt pulley block and the like to achieve the similar effect.

Preferably, the direction in which the traction member 54 draws the pumping rod is in a line with the moving direction of the pumping rod, and this can ensure that the pumping rod of the downhole pump can work, for long period of time, and elongate its service life.

The sensor 6 preferably is a displacement sensor, such as an angle encoder or rotary encoder. The angle encoder or rotary encoder can be mounted on the pulley block 53, such as on the movable pulley 532, and obtain the linear displacement of the traction member 54 by detecting the number of revolutions of the movable pulley 532 so as to attain the stroke of the pumping rod. The sensor 6 may be other displacement sensors that can be used for directly measuring linear displacement of the traction member 54 and setting the stroke of the pumping rod, such as magnetic induction detection means, or such as two normally-closed or normally-opened type proximity switches that are spaced apart from each other in the upper-and-down direction, such as an upper proximity switch 61 and a lower proximity switch 62 shown in FIG. 1. The stroke of the pumping rod is determined by the distance between the two proximity switches. The sensor 6 also may be an analogue sensor, which can not only determine the limit position of the reciprocating movement of the pumping rod and its travelling direction, but also the accurate position of the pumping rod at any time, so that theoretically the stroke can be changed at any position within the maximum stroke range.

Figure 2:
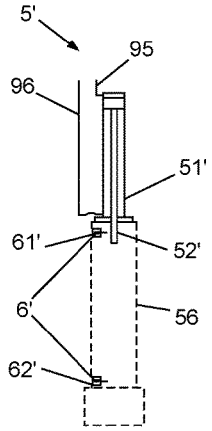
FIG. 2 is a view illustrating another embodiment of a pumping rod driving device of a power unit of a hydraulic pumping unit.

According to another illustrative embodiment, the pumping rod driving device of the present invention also can have the structural form illustrated in FIG. 2. The pumping rod driving device 5' comprises an oil cylinder 51' and a cylinder piston rod 52' reciprocating within the oil cylinder 51'. The oil cylinder 51' is supported on a cylinder holder 56. The oil cylinder 51' is divided into upper and lower chambers by the upper end of the cylinder piston rod 52', and the upper chamber is connected to a first hydraulic line 95 while the lower chamber is connected to a second hydraulic line 96. The lower end of the cylinder piston rod 52' is attached to the pumping rod. Provided on the cylinder holder 56 are sensors 6', i.e., an upper proximity switch 61' and a lower proximity switch 62', for setting the stroke of the cylinder piston rod 52' (i.e., the pumping rod).

Further, according to another illustrative embodiment, the pumping rod driving device of the present invention also may be a hydraulic winch, and a cable or belt and the like of the hydraulic winch can be used to drive the up-down reciprocating movement of the pumping rod.

According to one simple illustrative embodiment, the first control valve 7 is only used for controlling the on and off of the variable pump 2. Here, the first control valve 7 may be any suitable means capable of controlling the on and off of the variable pump 2. Preferably, in addition to controlling the on and off of the variable pump 2, the first control valve 7 also can adjust the displacement of the variable pump 2. Here, the first control valve 7 may be for example a proportional valve, such as a proportional relief valve or a proportional reversing valve and the like, which has a proportional electromagnet 71, and whether the proportional electromagnet is electrified is determined by the signals from the sensor 6, so as to control the on and off of the variable pump 2. Further, the displacement of the variable pump 2 can be adjusted by means of the magnitude of electrical current that energizes the proportional electromagnet 71, so as to change the moving speed of the pumping rod. The first control valve 7 also may be a common electromagnetic reversing valve or a pressure valve or a combination thereof. Here, the speed can not be electrically adjusted, but manual adjustment is allowable.

The second control valve 8 preferably is a proportional valve, such as a proportional relief valve or a proportional reversing valve and the like, which has two proportional electromagnets 81, 82, and the individual proportional electromagnets are electrified based on the signals from the sensor 6, so as to switch the operating mode of the secondary hydraulic control unit 3, such as switching the operating mode of the bidirectional plunger pump. Further, the displacement of the bidirectional plunger pump can be adjusted by means of the magnitude of electrical current that energizes the proportional electromagnets 81, 82, so as to change the moving speed of the pumping rod. Similarly, the second control valve g may be a common electromagnetic reversing valve or a pressure valve or a combination thereof. Here, the speed can not be electrically adjusted, but manual adjustment is allowable.

The power unit 100 further comprises an oil tank for supplying oil to the variable pump 2, the control pump 10, the secondary hydraulic control unit 3 and so on. Preferably, all the members that need to be supplied with oil are connected to one common oil tank to further simplify the structure and reduce cost.

One illustrative working cycle of the power unit 100 is described hereinafter based on the power unit 100 in FIG. 1.

At first, the cylinder piston rod 52 is located at the lower dead point of its stroke, and the sensor 6 produces a signal for indicating that the cylinder piston rod 52 is at the lower dead point. At this moment, the first control valve 7 receives the signal from the sensor 6 to turn on the variable pump 2, and the second control valve 8 receives the signal from the sensor 6 to make the secondary hydraulic control unit 3 as a pump. Here the flywheel 4 is in the standstill state, and thus the secondary hydraulic control unit 3 actually does not function as a pump. In this case, only the variable pump 2 actually causes the cylinder piston rod 52 to move upward. During this moving process, it is preferable to allow the first control valve 7 to realize small discharge with small control quantity, such that the cylinder piston rod 52 moves at low speed to avoid requiring the great motor power.

When the cylinder piston rod 52 ascends to the upper dead point of its stroke, the sensor 6 produces a signal for indicating that the cylinder piston rod 52 is at the upper dead point and will move downwards. The first control valve 7 receives the signal from the sensor 6 to set the displacement of the variable pump 2 to be zero, and the second control valve 8 receives the signal from the sensor 6 to change the operating mode of the secondary hydraulic control unit 3 to act as a motor, and simultaneously switch on the hydraulically-controlled cheek valve 94. The secondary hydraulic control unit 3 converts gravitational potential energy generated by drop of the cylinder piston rod 52 and structural members moving with the cylinder piston rod 52 into moment of torque at its output end to enable accelerated rotation of the flywheel 4, so as to store the gravitational potential energy.

When the cylinder piston rod 52 drops to the lower dead point of its stroke, the sensor 6 produces a signal for indicating that the cylinder piston rod 52 arrives at the lower dead point and will move upwards. The first control valve 7 receives the signal from the sensor 6 to turn on the variable pump 2, and the second control valve 8 receives the signal from the sensor 6 to change the operating mode of the secondary hydraulic control unit 3 to act as a pump. Thereby, the motor 1 and the rotary flywheel 4 as power sources drive, the variable pump 2 and the secondary hydraulic control unit 3 respectively and collectively cause the cylinder piston rod 52 to move upwards. Thereafter, the running moves in cycles.

During the above working cycle, the gravitational potential energy generated by drop of the cylinder piston rod 52 and structural members moving with the cylinder piston rod 52 is stored by the flywheel 4 and then is used for driving the cylinder piston rod 52 to move upwards, thereby utilizing the descending potential energy to the largest degree and save the energy.

According to one illustrative embodiment, when the secondary hydraulic control unit is a bidirectional plunger pump, it is possible to make the bidirectional plunger pump function as a pump by setting the swinging angle of the bidirectional plunger pump to be positive, such as +5° or +15°, and as a motor by setting the swinging angle of the bidirectional plunger pump to be negative, such as −10° or −15°. During the practice, the swinging angle of the bidirectional plunger pump can be varied according to the requirements to vary its displacement, so as to control the up-down moving speed of the pumping rod. Obviously, the swinging angle of the bidirectional plunger pump is not limited to the above illustrative angles.

Moreover, according to one illustrative embodiment, a hydraulic divider motor also can be provided in the drive hydraulic line 9, and a plurality of pumping rod driving devices can be driven simultaneously by the hydraulic divider motor so as to pump oil from a plurality of wells simultaneously.

According to the present invention, since the flywheel is connected to the secondary hydraulic control unit in a transmission mode, not to the motor, the flywheel has the greater speed variation range so that the flywheel can accumulate more potential energy, thereby enhancing the energy recycling utilization efficiency and reducing the performance requirements and cost for the motor.

Please note that although the flywheel is discussed in details as one embodiment, other types of accumulators also are allowable. The accumulator and the secondary hydraulic control unit are not connected to the motor in a transmission mode any more, and thus at least the property requirements on the motor are lowered and it is possible to enlarge the selection range of the motor.

For one skilled in the art, other advantages and alternative embodiments of the present invention are obvious. The present invention is not limited to the described and illustrated details, representative structures and illustrative embodiments in terms of the broader meaning. Indeed, one skilled in the art can make various substitutions and changes without departing from the basic spirit and range of the inventions.

The invention claimed is:

1. A power unit of a hydraulic pumping unit, comprising:

a motor;

a pumping rod driver that drives reciprocating movement of a pumping rod;

a variable pump driven by the motor, the variable pump hydraulically connected to the pumping rod driver;

a secondary hydraulic control unit hydraulically connected to the pumping rod driver;

an energy accumulator operably connected to the secondary hydraulic control unit and configured to store potential energy from the secondary hydraulic control unit;

a sensor configured to generate signals based on a position of the pumping rod;

a first control valve hydraulically connected to the variable pump and configured to, based on the signals from the sensor, set a flow through the variable pump to be zero during a descending motion of the pumping rod and to set the flow through the variable pump to be positive toward the pumping rod driver during an ascending motion of the pumping rod to drive the pumping rod driver; and a second control valve hydraulically connected to the secondary hydraulic control unit and configured to, based on the signals from the sensor, set the secondary hydraulic control unit to function as a motor and store potential energy in the energy accumulator during the descending motion of the pumping rod, and to set the secondary hydraulic control unit to be driven by the stored potential energy in the energy accumulator such that the secondary hydraulic control unit functions as a pump to drive the pumping rod driver during the ascending motion of the pumping rod.

2. The power unit according to claim 1, wherein the secondary hydraulic control unit is a bidirectional plunger pump.

3. The power unit according to claim 1, wherein each of the first and second control valves includes one selected from the group consisting of (i) a proportional relief valve, (ii) a proportional reversing valve, and (iii) a combination of an electromagnetic reversing valve and a pressure valve.

4. The power unit according to claim 1, wherein a direction in which the pumping rod driver drives the pumping rod is in a line with a moving direction of the pumping rod.

5. The power unit according to claim 1, further comprising:

a control pump configured to supply the variable pump with control oil via the first control valve and to supply the secondary hydraulic control unit with the control oil via the second control valve, the control pump being in transmission connection with the variable pump and coaxially disposed with the motor and the variable pump.

6. The power unit according to claim 1, wherein the sensor is an analogue sensor or consists of an upper proximity switch and a lower proximity switch.

7. The power unit according to claim 1, further comprising:

a hydraulic divider motor adapted to drive the pumping rod driver simultaneously with at least one additional pumping rod driver.

8. The power unit according to claim 1, wherein the pumping rod driver comprises an oil cylinder or hydraulic winch.

9. The power unit according to claim 1, further comprising:

a check valve located in a hydraulic line between the variable pump and the pumping rod driver, the check valve configured to allow hydraulic oil to only flow from the variable pump to the pumping rod driver and to prevent any flow of the hydraulic oil from the pumping rod driver to the variable pump.

10. The power unit according to claim 1, wherein the energy accumulator is a flywheel mechanically connected to the secondary hydraulic control unit.

11. The power unit according to claim 1, further comprising:

a hydraulically-controlled check valve located between the secondary hydraulic control unit and the pumping rod driver, the hydraulically-controlled check valve being hydraulically controlled into an open state during the descending motion of the pumping rod, and, the hydraulically-controlled check valve configured to prevent hydraulic oil from flowing from the pumping rod driver to the secondary hydraulic control unit in case of shutdown.

12. A hydraulic pumping unit, comprising:

a pumping rod; and at least one power unit including:

a motor, a pumping rod driver that drives reciprocating movement of the pumping rod, a variable pump driven by the motor, the variable pump hydraulically connected to the pumping rod driver, a secondary hydraulic control unit hydraulically connected to the pumping rod driver, an energy accumulator operably connected to the secondary hydraulic control unit and configured to store potential energy from the secondary hydraulic control unit, a sensor configured to generate signals based on a position of the pumping rod, a first control valve hydraulically connected to the variable pump and configured to, based on the signals from the sensor, set a flow through the variable pump to be zero during a descending motion of the pumping rod and to set the flow through the variable pump to be positive toward the pumping rod driver during an ascending process of the pumping rod to drive the pumping rod driver, and a second control valve hydraulically connected to the secondary hydraulic control unit and configured to, based on the signals from the sensor, set the secondary hydraulic control unit to function as a motor to store potential energy in the energy accumulator during the descending motion of the pumping rod, and to set the secondary hydraulic control unit to be driven by the stored potential energy in the energy accumulator such that the secondary hydraulic control unit functions as a pump to drive the pumping rod driver during the ascending motion of the pumping rod.

* * * * *